US005526003A

United States Patent [19]

Ogawa et al.

[11] Patent Number: 5,526,003

[45] Date of Patent: Jun. 11, 1996

[54] ANTENNA FOR MOBILE COMMUNICATION

[75] Inventors: Koichi Ogawa; Tomoki Uwano, both of Hirakata; Masao Takahashi, Chigasaki, all of Japan

[73] Assignee: Matsushita Electric Industrial Co., Ltd., Osaka, Japan

[21] Appl. No.: 282,917

[22] Filed: Jul. 29, 1994

[30] Foreign Application Priority Data

Jul. 30, 1993 [JP] Japan ..... 5-188565
Feb. 25, 1994 [JP] Japan ..... 6-27124

[51] Int. Cl.[6] ..... H01Q 1/27

[52] U.S. Cl. ..... 343/700 MS; 343/713; 343/752; 343/830; 343/846; 343/848

[58] Field of Search ..... 343/700, 702, 343/713, 830, 846, 847, 848, 752

[56] References Cited

U.S. PATENT DOCUMENTS

| | | | |
|---|---|---|---|
| 2,996,713 | 8/1961 | Boyer | 343/745 |
| 4,386,357 | 5/1983 | Patton | 343/700 MS |
| 4,701,763 | 10/1987 | Yamamoto et al. | 343/700 |
| 4,771,291 | 9/1988 | Lo et al. | 343/700 |
| 4,992,800 | 2/1991 | Parfitt | 343/713 |
| 5,061,939 | 10/1991 | Nakase | 343/846 X |
| 5,278,572 | 1/1994 | Harada et al. | 343/713 X |
| 5,313,216 | 5/1994 | Wang et al. | 343/895 X |
| 5,343,214 | 8/1994 | Hadzoglou | 343/713 |

FOREIGN PATENT DOCUMENTS

| | | |
|---|---|---|
| 0366393 | 5/1990 | European Pat. Off. . |
| 0526643 | 2/1993 | European Pat. Off. . |
| 2553586 | 4/1985 | France . |
| 4-129302 | 4/1992 | Japan . |
| WO90/05390 | 5/1990 | WIPO . |

OTHER PUBLICATIONS

"Characteristics of Body–Mounted Antennas for Personal Radio Sets"; by H. E. King, IEEE Transactions on Antennas and Propagation, vol. AP23, No. 2, Mar. 1975, pp. 8082–8084.

Copy of Search Report from European Counterpart application 94111720.2, dated Oct. 19, 1994.

"Performance Analysis of a Built–In Planar Inverted F Antenna for 800 MHz Band Portable Radio Units"; by Tokio Taga et al., IEEE Journal on Selected Areas in Communications, vol. SAC–5, No. 5, Jun. 1987, pp. 921–929.

*Primary Examiner*—Donald T. Hajec
*Assistant Examiner*—Tho Phan
*Attorney, Agent, or Firm*—Ratner & Prestia

[57] ABSTRACT

An antenna for mobile communication of this invention comprises a first metal plate having a slit, a second metal plate opposed to the first metal plate and electrically connected to the first metal plate, two metal foils connected to the second metal plate, and a cable for supplying feed signals to the first metal plate and the second metal plate, the cable including a first conductor connected to the first metal plate via a capacitor and a second conductor connected to the second metal plate.

3 Claims, 12 Drawing Sheets

ANTENNA FOR MOBILE COMMUNICATION

BACKGROUND OF THE INVENTION

1. Field of the Invention

The present invention relates to an antenna used mainly in mobile telecommunication, particularly to a compact antenna suited to be mounted on the shoulder of a human body.

2. Description of the Related Art

In recent years, demands for mobile communications using a radio unit such as a portable telephones have been remarkably increasing. Such a radio unit may comprise a compact and low profile type planar antenna. As a compact antenna for a portable telephone, the planar inverted F antenna has been used. Constitution of such an antenna is described in "Performance Analysis of a Built-in Planar Inverted F Antenna for 800 MHz Band Portable Radio Units", T. Taga and K. Tsunekawa, IEEE Trans., vol. SAC-5, No. 5, pp. 921–929 (1987) and in the Japanese Patent Application No. 2-250655. The planar inverted F antenna is compact in construction, and is capable of transmitting and receiving both vertically and horizontally polarized waves, and is therefore suitable for portable telephones used in a multiple propagation environment.

However, in the prior art described above, since the planar inverted F antenna is installed on the body case of the radio unit and the antenna is located close to the human body during the operation of the potable telephone, the gain of the antenna decreases significantly. Also since the planar inverted F antenna functions as an antenna when it is connected to the body case of a radio unit having a ground plane sufficiently large relative to the antenna, it has been impossible to install the antenna separately from the radio unit. As a result, there has been a limit to the size reduction of the radio unit, and it has been impossible to reduce the size of a radio unit to such an extent that it causes no trouble to the user at all to carry it. Thus the use of such a conventional radio unit which is not compact enough has been inconvenient, particularly for those engaged in jobs which require them to always carry the radio units with them.

SUMMARY OF THE INVENTION

An antenna for mobile communication according to the invention comprises a first metal plate; a second metal plate opposed to the first metal plate, and electrically connected to the first metal plate; and a cable for supplying feed signals to the first metal plate and the second metal plate, the cable including a first conductor connected to the first metal plate via a capacitor and a second conductor connected to the second metal plate.

In one embodiment of the invention, the antenna further comprises a dielectric substrate having a through-hole formed between the first metal plate and the second metal plate, and the first metal plate and the second metal plate are connected to each other via the through-hole.

In another embodiment of the invention, the first metal plate and the second metal plate are connected to each other by means of a metal wire and the first metal plate and the second metal plate are fixed by the metal wire at a predetermined distance apart.

In another embodiment of the invention, the antenna further comprises a fixing means to fix the first metal plate and the second metal plate to each other.

In another embodiment of the invention, the first metal plate has a slit.

In another embodiment of the invention, the length of the slit is in the range of 20 mm to 60 mm.

In another embodiment of the invention, the antenna further comprises a first metal foil connected to a first end of the second metal plate and a second metal foil connected to the second end opposite the first end of the second metal plate.

In another embodiment of the invention, each of the lengths of the first metal foil and the second metal foil is in the range of 30 mm to 150 mm.

In another embodiment of the invention, the antenna further comprises a third metal foil connected to a third end interposed between the first end and the second end of the second metal plate and a fourth metal foil connected to a fourth end opposite the third end of the second metal plate.

In another embodiment of the invention, each of the lengths of the third metal foil and the fourth metal foil is in the range of 20 mm to 50 mm.

In another embodiment of the invention, the shape of the first metal plate is a meander line configuration.

In another embodiment of the invention, the shape of at least one of the first to fourth metal foils is a meander line configuration.

In another embodiment of the invention, the first metal plate and the second metal plate have substantially the same sizes and are installed substantially parallel to each other.

In another embodiment of the invention, each of the length and the width of the first metal plate is equal to or less than 65 mm.

In another embodiment of the invention, the distance between the first metal plate and the second metal plate is equal to or less than 30 mm.

In another embodiment of the invention, the cable is a coaxial cable, and the first conductor constitutes the inner conductor of the coaxial cable and the second conductor constitutes the outer conductor of the coaxial cable.

In another embodiment of the invention, the capacitor is a variable capacitor.

The first metal plate and a second metal plate of the antenna of the invention function as antenna elements to transmit and receive radio waves. The first metal plate and the second metal plate are connected to the cable and the plates can be connected to a main body of the radio unit via the cable. This arrangement makes it possible to separate the antenna from the radio unit. In addition, since power can be fed to the antenna element via the capacitor, it is possible to attain appropriate matching of the antenna without using a ground plane. Further, better characteristics of the antenna can be obtained by employing a variable capacitor as the capacitance and properly adjusting the capacitance of the variable capacitor. Thus it is possible to minimize the impedance change and the gain decrease even when the antenna is mounted closer to the human body.

The first metal plate and the second metal plate can be fixed by a dielectric substrate in a stable manner. Consequently, deterioration in the antenna characteristics caused by the change of the distance between both of the metal plates, or the like, while the antenna is mounted (or carried) on the human body, can be prevented. Further, because the metal plates are connected to each other via a through hole provided inside the dielectric substrate, it is possible to further reduce the antenna size.

Also because the first metal plate and the second metal plate can be fixed by the metal wire and/or the fastening means, deterioration in the antenna characteristics caused by a deformation of the antenna can be prevented even when the antenna is mounted (or carried) on the human body.

Also because the first metal plate has a slit, peripheral length of the metal plate can be increased relative to the size of the metal plate which is an antenna element. Since the peripheral length of the metal plate corresponds to the resonance frequency of the antenna, providing the slit enables further reduction of the size of the metal plate for a prescribed frequency.

The size of the metal plate can be further reduced while maintaining good characteristics of the antenna by making the slit length in the range of 20 mm to 60 mm.

The first metal foil and the second metal foil connected to the first end and the second end of the second metal plate respectively, are suspended in front and back of the shoulder, respectively, when the antenna is mounted (or carried) on the shoulder of a human body or the like, thereby stably fastening the antenna on the shoulder. Also by attaching the metal foils to the second metal plate, change in the resonance frequency can be decreased when the antenna is mounted on the human body, and changes of the impedance and deterioration of the gain can be suppressed within extremely low levels.

By connecting the third and the fourth metal foils to the second metal plate, the first and the second metal foils can be made shorter and the change in the resonance frequency can be decreased when the antenna is mounted on the human body.

By making the first metal plate in meander line configuration, the peripheral length of the metal plate can be further increased relative to the size of the metal plate. Consequently, the size of the metal plate for a prescribed frequency can be further reduced.

By making at least one of the metal foils in a meander line configuration, a gain of the antenna can further be increased.

Since the first metal plate can be made to an extremely small size, the antenna can be made easier to mount on a human body.

Further, the first metal plate and the second metal plate are installed close to each other with a very small distance, and therefore the antenna can be made easier to mount on a human body.

Furthermore, the antenna of the invention can be connected to the body case of the radio unit by means of a coaxial cable, and is therefore capable of transmitting and receiving stable electromagnetic waves without catching noise.

The most important feature of the invention is that the metal foils, preferably formed in the configuration of meander line, are connected to the antenna element, and such constitution makes a large ground plane unnecessary for the antenna. Therefore the antenna can be made compact enough to be suitable for mounting on a human body, and even when the antenna is installed close to the human body, changes of the impedance and deterioration of the gain can be suppressed within extremely low levels.

Thus, the invention described herein makes possible the advantages of (1) providing an antenna for mobile communication which is separated from the body case of the radio unit in order to make the radio unit sufficiently compact, (2) providing an antenna for mobile communication which is compact and light-weight enough to be easily mounted on a human body, (3) providing an antenna for mobile communication which causes little or no deterioration of the basic antenna characterizes such as impedance and gain, or the like, caused by the human body on which the antenna is mounted, and (4) providing an antenna for mobile communication which can be mounted on a portion of a human body where the influence of the human body is relatively small (on the shoulder, for example) in a stable manner.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of examples, with reference to the accompanying drawings.

EXAMPLE 1

Figure 1:
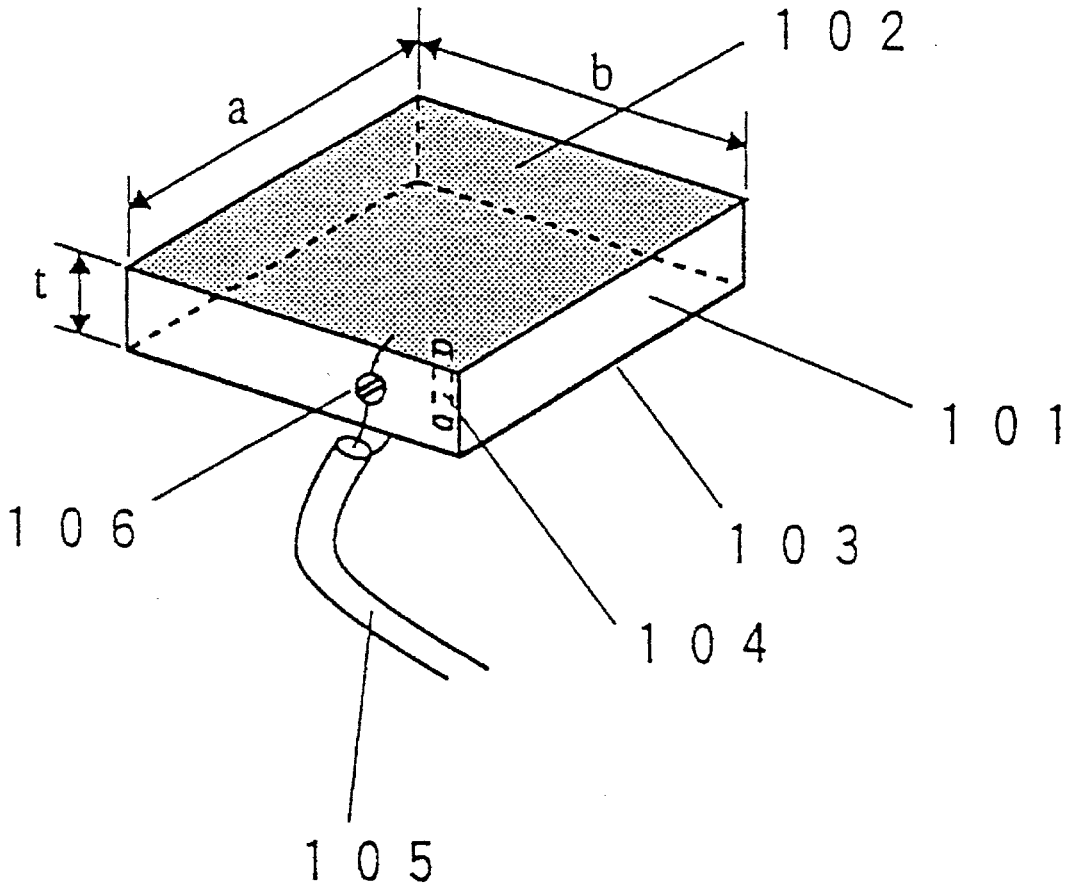
FIG. 1 is a perspective view of an antenna for mobile communication of the first embodiment of the invention.

FIG. 1 shows the constitution of a first embodiment of a planar antenna for mobile communication according to the invention.

The planar antenna of this embodiment includes an antenna element 102 which is a first metal plate and an antenna element 103 which is a second metal plate. The antenna element 102 is formed on a first face of a dielectric substrate 101 having thickness of t, and the antenna element 103 is formed on a second face of the dielectric substrate 101 which opposes the first face. The material used in the dielectric substrate 101 of this embodiment is not limited to a particular substance, but may be any material having a dielectric property. The sizes of a face of the antenna element 102 and a face of the antenna element 103 are given by "a (length)×b (width)". The antenna element 102 and the antenna element 103 have substantially the same sizes and are installed substantially parallel to each other. The antenna element 102 and the antenna element 103 are electrically connected to each other via a through-hole 104 formed near a corner of the dielectric substrate 101.

The antenna of this embodiment also has a coaxial cable 105 having an inner conductor which is a first conductor (wire) and an outer conductor which is a second conductor (wire). The inner conductor of the coaxial cable 105 is connected to the antenna element 102 via a trimmer capacitor 106 which is a variable capacitor used for impedance matching of the antenna, and the outer conductor is connected to the antenna element 103. The coaxial cable 105 is a cable used for supplying feed signals (power) to the antenna elements 102 and 103. Resonance frequency of the antenna is substantially determined by the peripheral lengths of $(2a+2b)$ of the antenna elements 102 and 103, and the peripheral length is approximately $\lambda/2$, where $\lambda$ is the wavelength of the frequency used for the antenna in the dielectric substrate 101, and can be determined by the formula $\lambda=\lambda o/\sqrt{\epsilon}$ ($\lambda o$: wavelength in free space, $\epsilon$: dielectric constant of the dielectric substrate). The resonance frequency is an approximate value, and a precise value thereof should be determined by experiment. A capacitor having an appropriate capacitance may be used as the trimmer capacitor 106.

Figure 2:
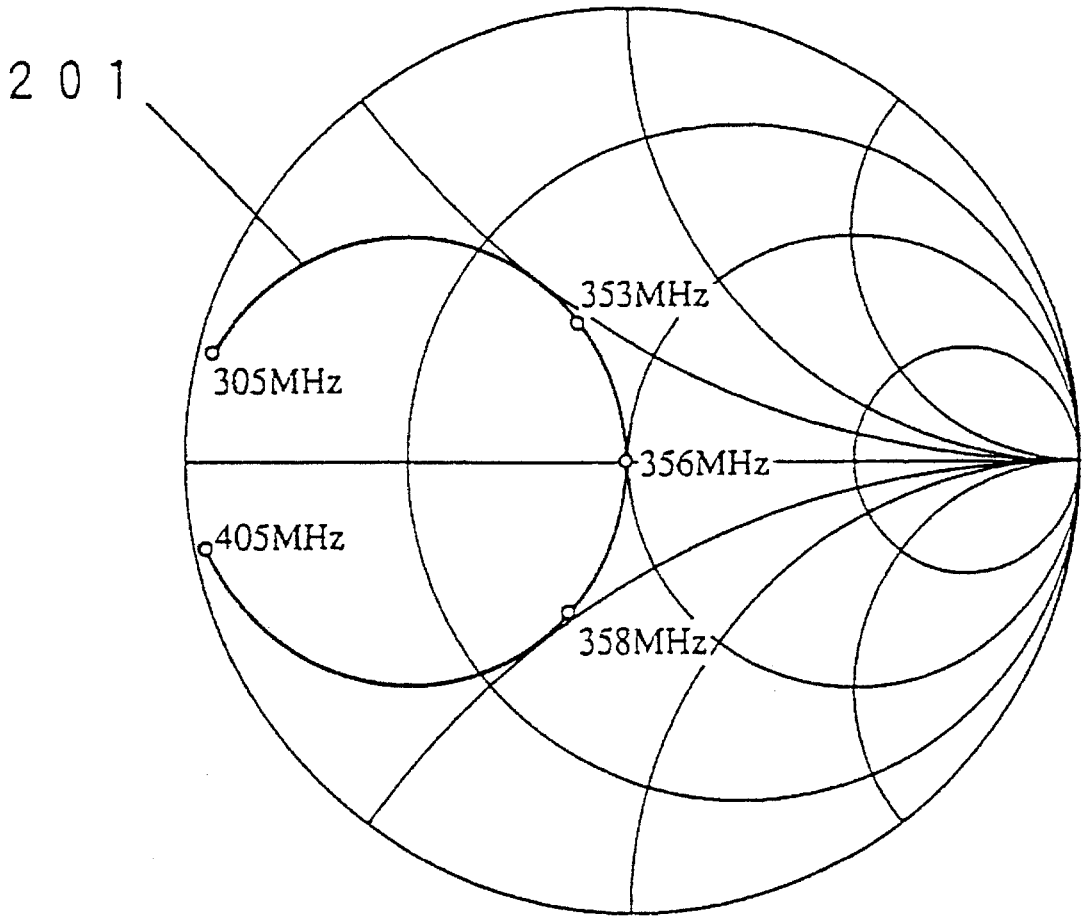
FIG. 2 is a graph showing impedance characteristics of the antenna of the first embodiment of the invention.

FIG. 2 shows a measured curve 201 of the impedance characteristics of the planar antenna for mobile communication having such a constitution as described above. The antenna elements 102 and 103 used in the measurement both have the size of a=b=65 mm, the dielectric substrate 101 has a thickness of t=10 mm, and the dielectric constant of the dielectric substrate 101 is 3.6. The frequency range in the measurement is from 305 MHz to 405 MHz. FIG. 2 indicates that the resonance frequency is 356 MHz. The frequencies of a electric wave with a voltage standing wave ratio (VSWR) of 2 are 353 MHz and 358 MHz, and the bandwidth where the voltage standing wave ratio is less than 2 (VSWR<2) is 5 MHz. Antenna matching varies depending on the distance between the through hole 104 and the feeding point of the coaxial cable 105, and on the capacitance of the trimmer capacitor 106, therefore good matching can be attained by choosing optimum values of the distance and the capacitance. Consequently, the planar antenna for mobile communication of this embodiment attains excellent matching although it does not require a ground plane.

The inventor of the present invention hit upon an idea of separating the antenna from the radio unit and mounting (putting) only the antenna on the human body, shoulder for instance, for the purpose of reducing the size and weight of a radio unit having the conventional planar inverted F antenna. However, when the antenna of a radio unit operating at a frequency about 350 MHz is separated from the unit, it requires a ground plane, which should be connected to the antenna element, measuring about 300 mm along one side. Therefore, it is impossible to use the antenna unit with only the antenna element separated from the unit and mounted on the human body. The inventor solved this problem by connecting the coaxial cable and the antenna element via a capacitor or a trimmer capacitor. This contrivance enables reduction of the size of the antenna element within 65 mm on one side, and make it possible for the first time to mount the antenna separately from the radio unit. Technology to improve the antenna performance and the technology to stably mount the antenna on the human body will be made clear through the description of this embodiment and the following embodiments.

Figure 3A:
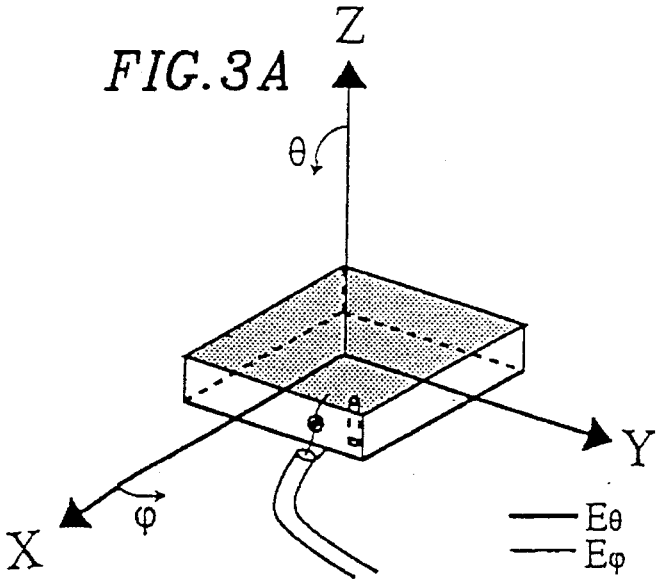
FIGS. 3A to 3D show radiation characteristics of the antenna of the first embodiment of the invention.
Figure 3B:
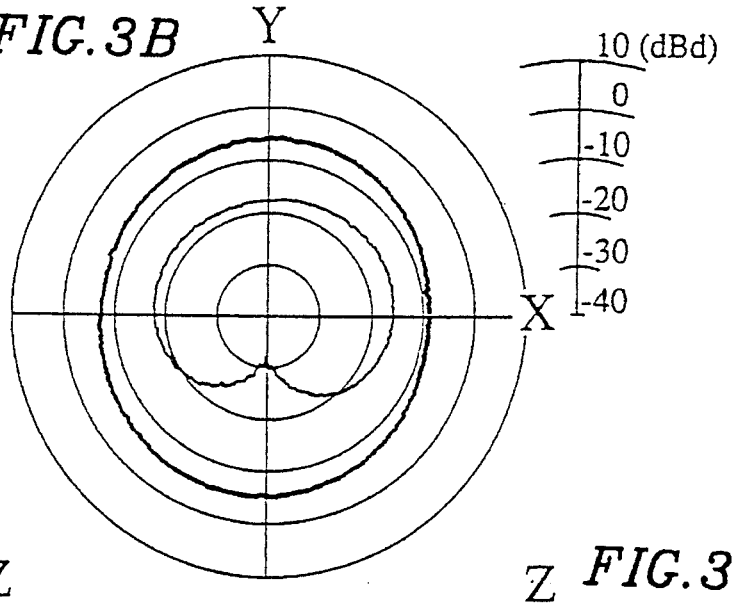
Figure 3C:
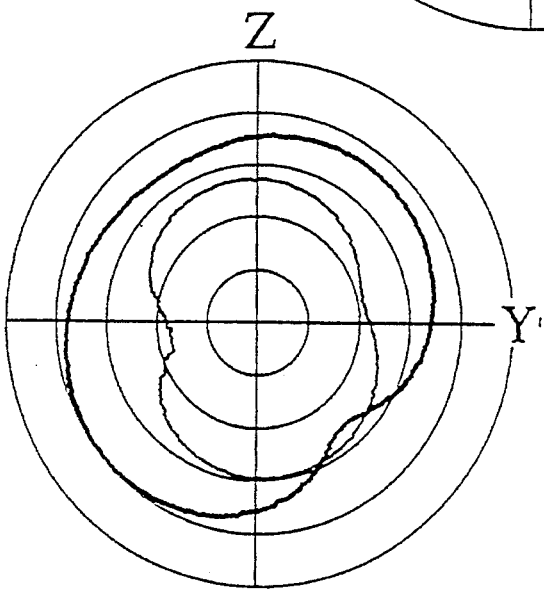
Figure 3D:
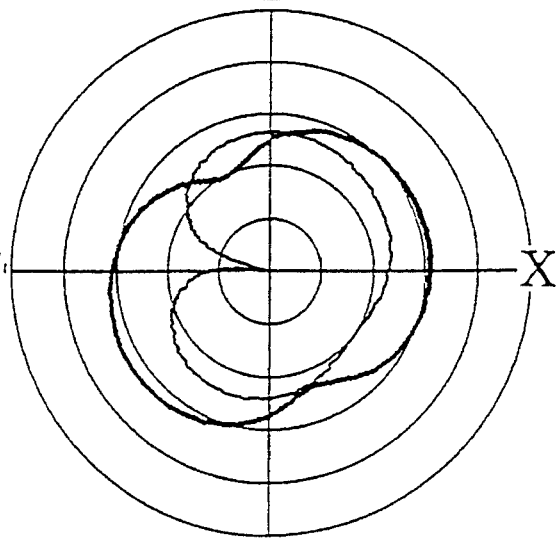

FIGS. 3A to 3D show antenna radiation patterns. Sizes of the antenna elements 102 and 103 are a=b=65 mm, and the dielectric substrate 101 has a thickness t=10 mm, and the dielectric constant of the dielectric substrate 101 is 3.6. The measurement frequency is 356 MHz. The radiation patterns were measured taking a standard dipole antenna as a reference. FIG. 3A shows directions of X, Y, Z, Eθ, and Eϕ used in this embodiment. In FIGS. 3B to 3D, thick lines represent the Eθ component of radiation pattern and thin lines represent the Eϕ component of radiation pattern. As will be understood from the radiation pattern in the X-Y plane shown in FIG. 3B, the Eθ component is substantially non-directional, and has a maximum radiation level of −5 dBd in the Y direction. Similarly as will be understood from the radiation patterns in Z-Y plane and Z-X plane shown in FIG. 3C and FIG. 3D, maximum radiation levels in these planes are directed slightly downward from the horizontal plane (X axis and Y axis), and the maximum radiation level is about 0 dBd. These measurements of radiation patterns show that the planar antenna for mobile communication of this embodiment has a high gain and a radiation pattern with strong emission in a direction near the horizontal plane which is suitable for mobile communication.

In the case of mounting the antenna of this embodiment on the human body, it is preferable to mount it on the shoulder in order to obtain good antenna performance. At the same time, for mounting the antenna stably on the shoulder and for maintaining good antenna performance, it is preferable to set both the length a and the width b of each of the antenna elements 102 and 103 equal to or less than 65 mm. Also it is preferable to set the distance between the antenna element 102 and the antenna element 103 equal to or less than 30 mm.

EXAMPLE 2

Figure 4:
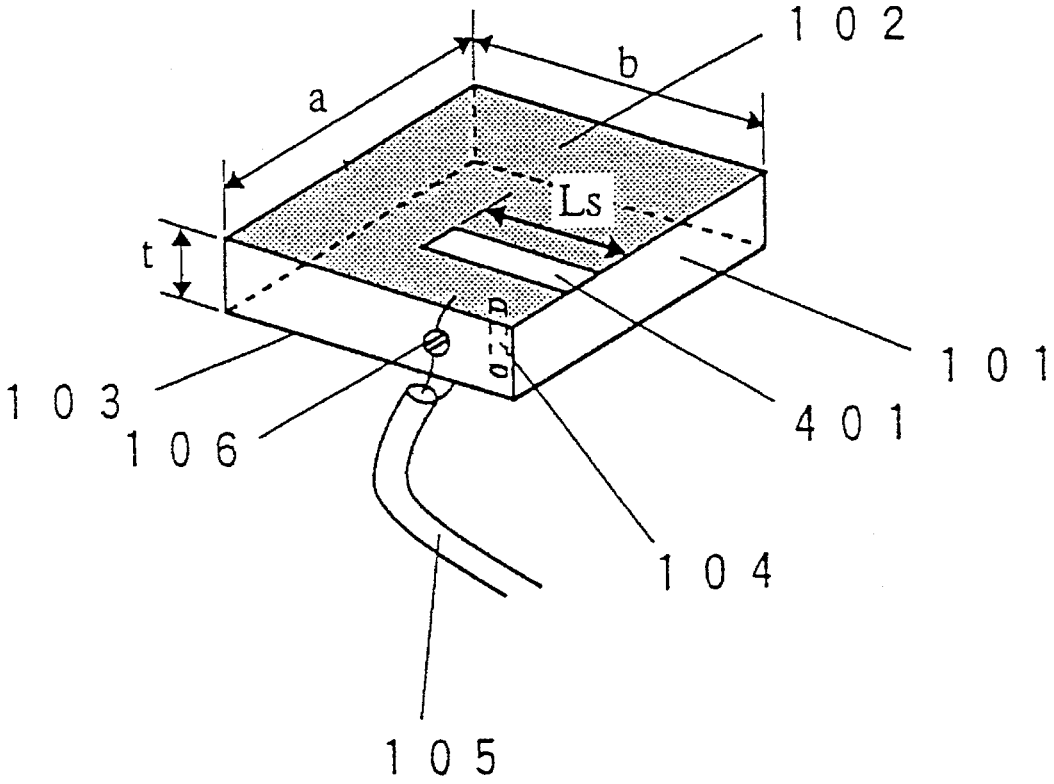
FIG. 4 is a perspective view of an antenna for mobile communication of the second embodiment of the invention.

FIG. 4 illustrates the constitution of the second embodiment of the planar antenna for mobile communication according to the invention. Among the members used in the second embodiment shown in FIG. 4, those having the same functions as the components in the first embodiment are denoted by the same numerals.

In this embodiment, the antenna element 102 has a slit 401 being formed from one end of the element inward. The slit 401 has a length Ls, and is employed to increase the peripheral length of the antenna element 102. Because the peripheral length of the antenna element 102 is in inverse proportion to the resonance frequency of the antenna, forming the slit 401 decreases the resonance frequency while length a and the width b of the antenna element 102 are remain constant. Sizes of the antenna element 102 a=b=50 mm, the dielectric substrate 101 has a thickness of t=10 mm, and the dielectric constant of the dielectric substrate 101 is 3.6.

Figure 5:
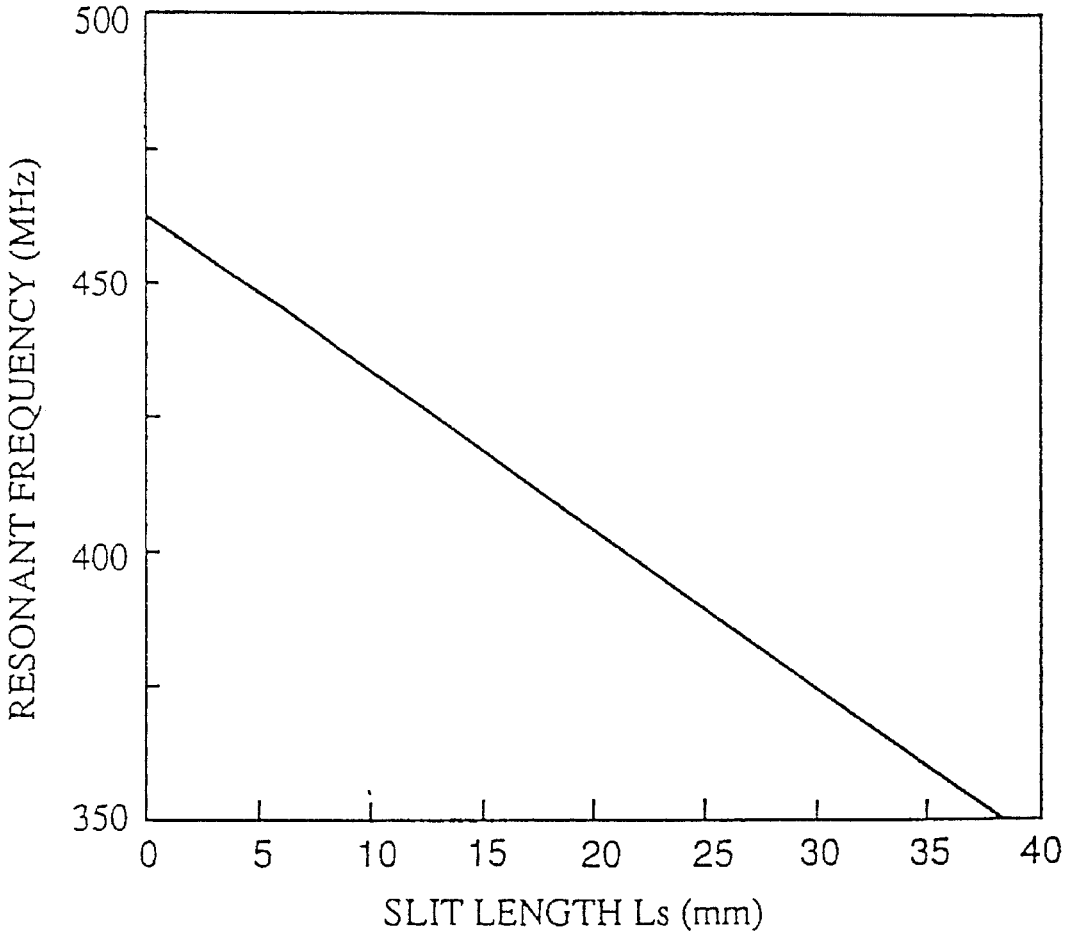
FIG. 5 shows the relationship between resonance frequencies and the slit length of the antenna of the second embodiment of the invention.

FIG. 5 shows a relationship between resonance frequencies and slit length of the antenna of this embodiment. From FIG. 5, it can be seen that the resonance frequency is 356 MHz when the slit length Ls is 36 mm. In the first embodiment where the antenna element 102 has no slit, resonance frequency is 356 MHz when the sizes of the antenna element are a=b=65 mm. This shows that the antenna size can be decreased by forming the slit 401. In order to reduce the antenna size and maintain the antenna strength, it is preferable to set the slit length in the range of 20 mm to 60 mm. An experiment showed that forming the slit 401 caused almost no change in the directivity pattern, but resulted in a slight decrease in the gain. In the case of a=b=50 mm, t=10 mm, and Ls=36 mm, described above, the Eθ component of the antenna directivity in the X-Y plane at frequency 356 MHz has a maximum level of −5.8 dBd.

EXAMPLE 3

Figure 6:
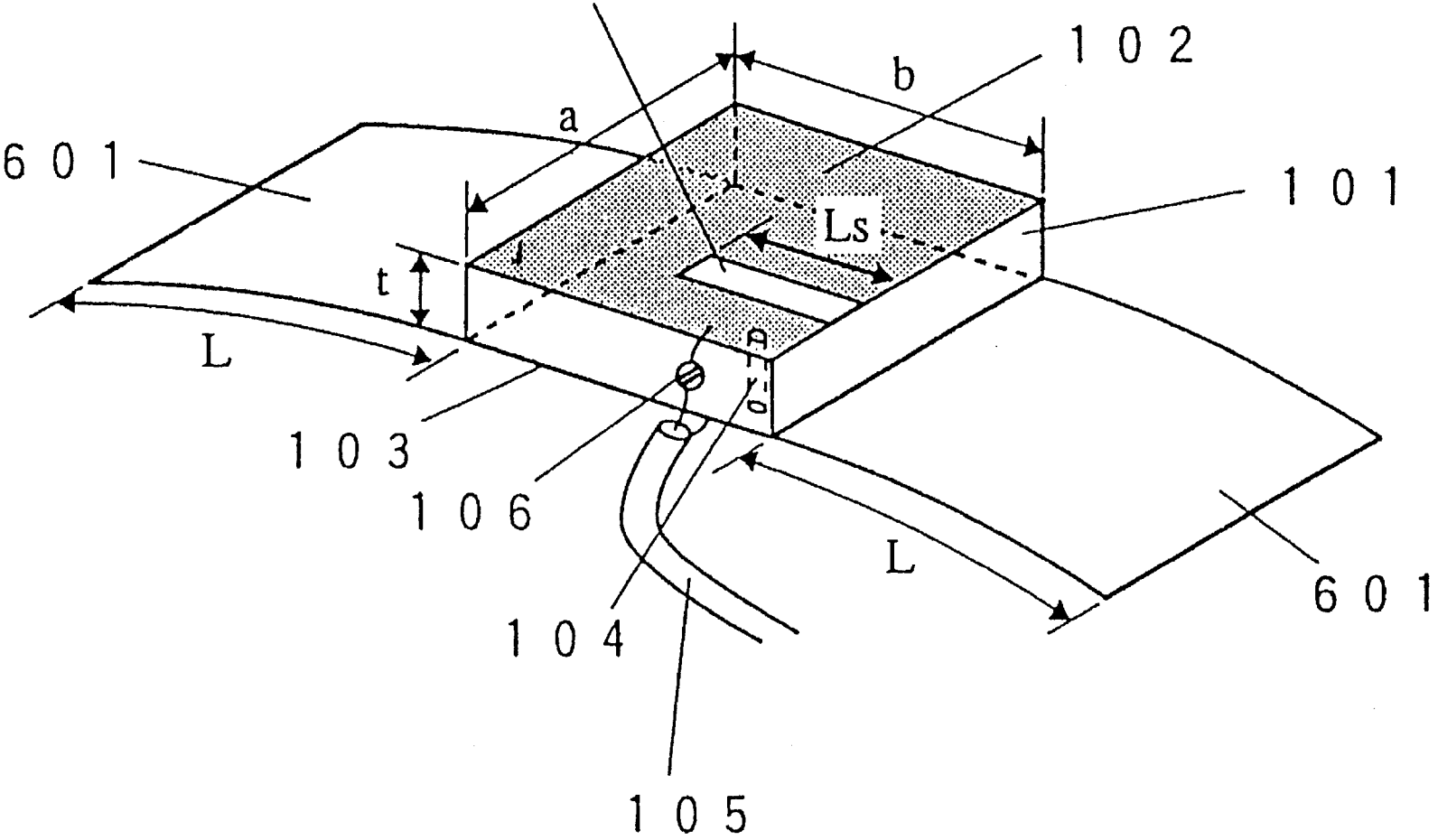
FIG. 6 is perspective view of an antenna for mobile communication of the third embodiment of the invention.

FIG. 6 illustrates the constitution of the third embodiment of the planar antenna for mobile communication according to the invention. Among the members used in the third embodiment, those having the same functions as the components in the first embodiment and the second embodiment are denoted by the same numerals, and description thereof will be omitted.

In this embodiment, a metal foil 601 made of aluminum formed in a strip having a length L, which is the first metal foil, is connected to the first end of the antenna element 103. The antenna element 103 opposes the antenna element 102 having the slit 401. Also a metal foil 601 made of aluminum formed in a strip having length L, which is the second metal foil, is connected to the second end of the antenna element 103 opposing the first end. The inventor discovered that characteristics of the antenna mounted on the human body can be improved by connecting the metal foils 601 to the antenna element 103. In this embodiment, the metal foils 601 function as part of the antenna element, and a standing wave is formed also in the metal foils 601. Use of the metal foils 601 will be described below.

Figure 7:
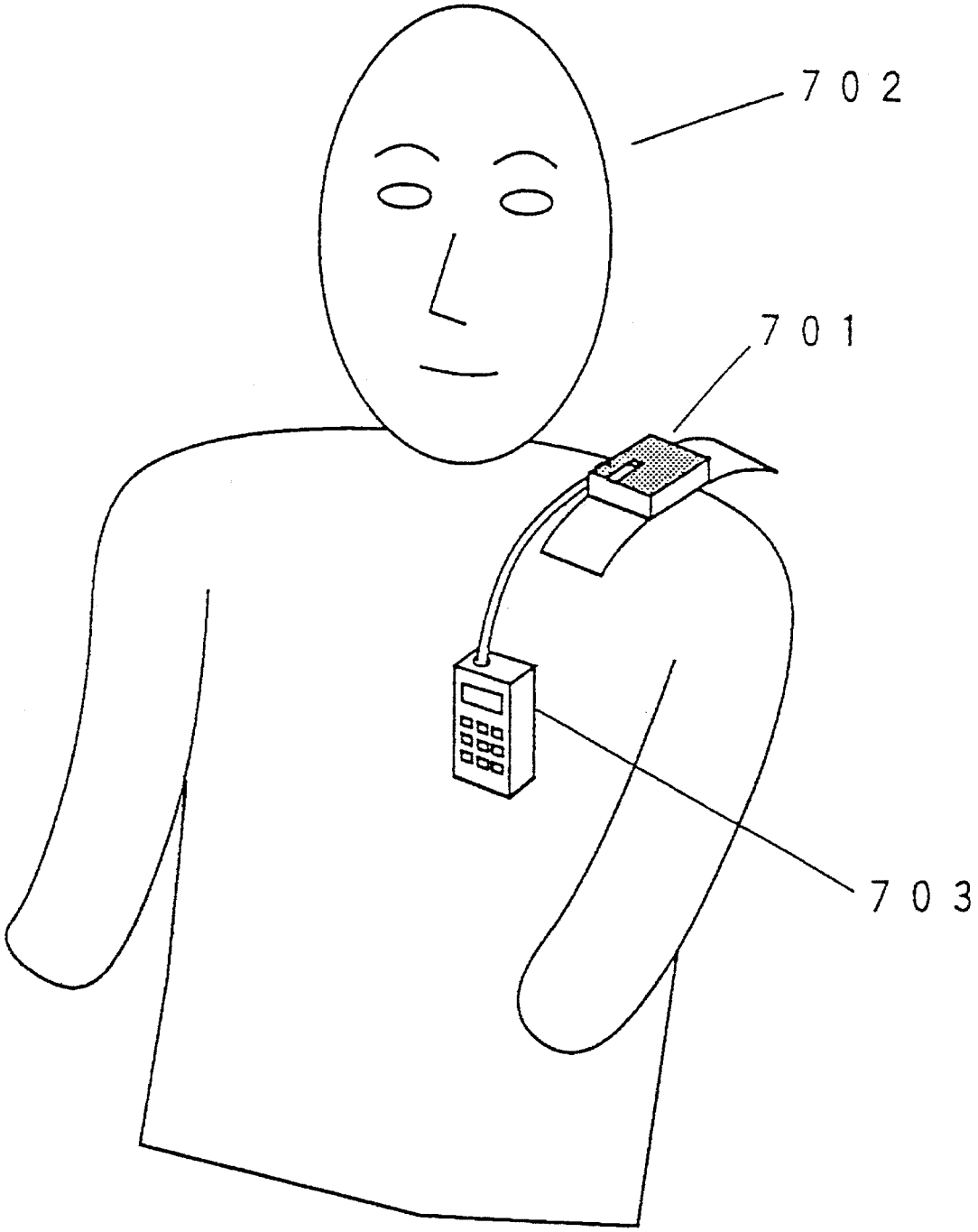
FIG. 7 is a view showing the antenna of the third embodiment of the invention being mounted on the shoulder of a human body.

FIG. 7 shows an antenna shown in FIG. 6 as mounted on the shoulder of a user 702. The antenna 701 is connected to the radio unit 703 via a coaxial cable. The metal foils 601 are very flexible and curve relatively freely so that they satisfactorily fit the outline of the shoulder and cause no annoyance to the user. Table 1 shows the resonance frequencies measured with and without the metal foils 601 in free space and measured with and without the metal foils 601 when the antenna was mounted on the human body. Dimensions of the antenna element 102 are a=b=50 mm the slit length Ls is 36 mm, and the dielectric substrate 101 has a thickness t=10 mm, while the dielectric constant of the dielectric substrate 101 is 3.6 and length of the metal foil L is 70 mm. Configurations of the components in this embodiment are the same as those of the second embodiment, except that the metal foils are used.

TABLE 1

| Resonance Frequencies | Free Space | On the Body |
|---|---|---|
| Without Metal Foils | 354 | 346.5 |
| With Metal Foils | 347 | 346 |

As will be seen from Table 1, the difference of the resonance frequencies measured in free space and those measured when the antenna is mounted on the human body, is 7.5 MHz, in the case where the metal foils are not attached to the antenna. However, the difference is decreased to 1 MHz, in the case where the metal foils are attached to the antenna. Thus change in the impedance when the antenna is brought close to a human body can be decreased by connecting the metal foils 601 to the antenna element 103. Significant change in the resonance frequency causes an increase in the mismatch loss, resulting in substantial decrease in the antenna gain, and it also leads to a significant change in the impedance of the load connected to the radio unit. Such changes make the operation of the radio unit unstable. These problems could be effectively solved by connecting the metal foils 601 to the antenna element 103.

Figure 8A:
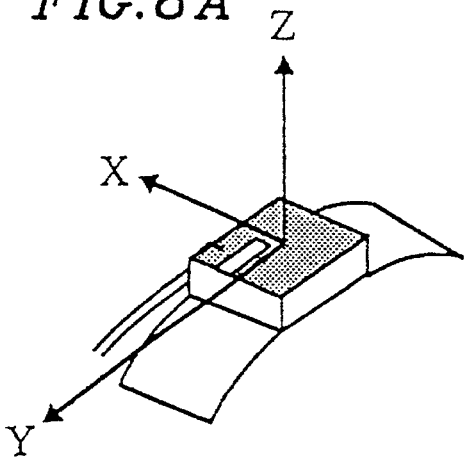
FIGS. 8A and 8B show the difference of the directivity between the cases where metal foils are provided and where they are not provided when the antenna of the third embodiment is mounted on the shoulder of a dummy human body.
Figure 8B:
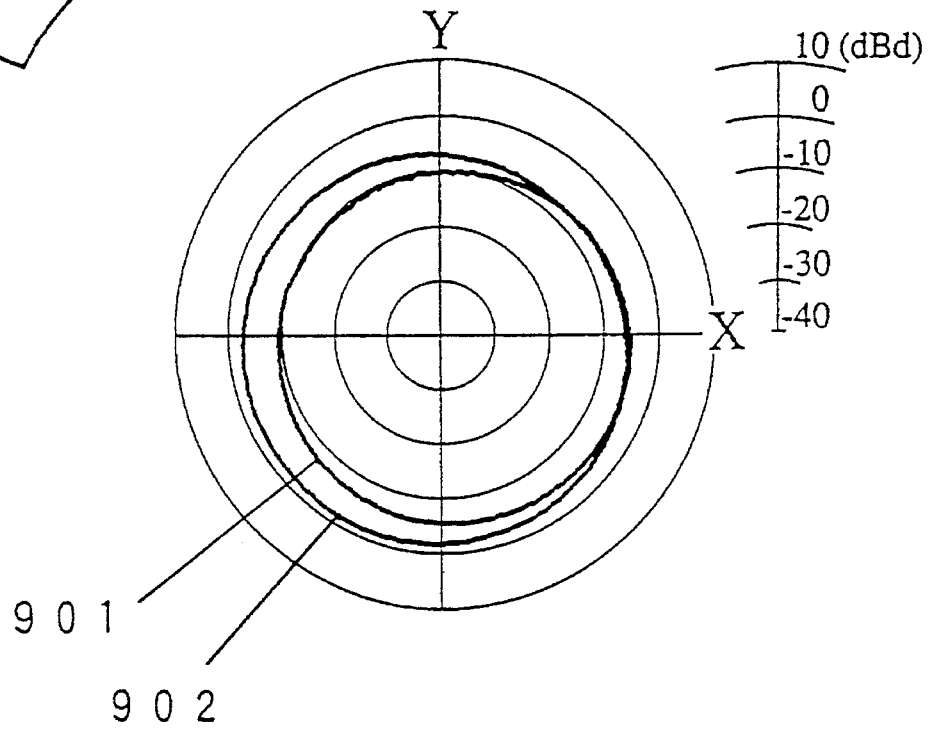

FIG. 8A indicates the X direction and the Y direction in this embodiment. FIG. 8B shows the Eθ component of the X-Y plane radiation pattern measured with the antenna of the third embodiment being mounted on a dummy human body. In FIG. 8B, numerals 902 and 901 indicate the Eθ components of the X-Y plane radiation pattern measured with and without the metal foils 601, respectively. While the gain in the direction of maximum radiation is about −5 dBd when no metal foil is provided, and is about −1 dBd when the metal foils are provided. Thus the gain when the antenna is mounted on a human body can be effectively increased by connecting the metal foils to the antenna element 103.

In order to mount the antenna 701 in a stable state and to increase the gain when mounted on the human body, it is preferable that the lengths L of the first metal foil and the second metal foil are in the range of 30 mm to 150 mm.

EXAMPLE 4

Figure 9:
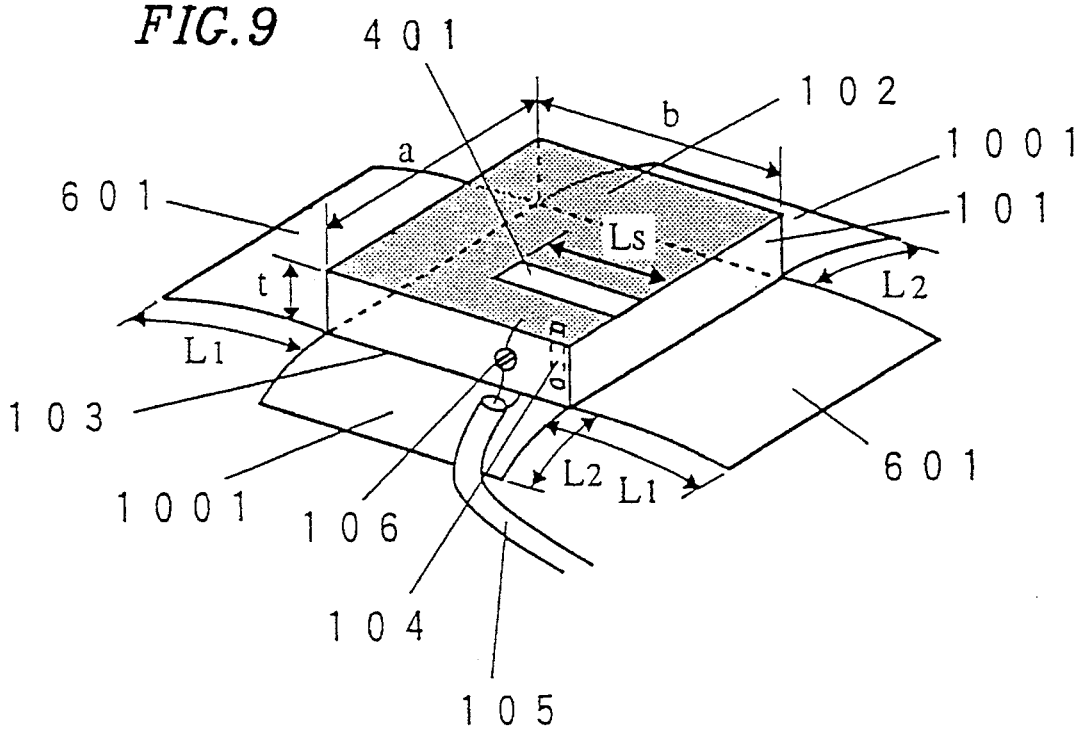
FIG. 9 is a perspective view of an antenna for mobile communication of the fourth embodiment of the invention.

FIG. 9 illustrates the constitution of the fourth embodiment of the planar antenna for mobile communication according to the invention. Among the members used in this embodiment, those having the same functions as the components in the first embodiment, the second embodiment and the third embodiment are denoted by the same numerals, and description thereof will be omitted.

In this embodiment, metal foils 601 made of aluminum formed in a strip of length L1, which are the first metal foil and the second metal foil, are connected to the first end and the second end of the antenna element 103, respectively. Also a metal foil 1001 made of aluminum formed in a strip of length L2, which is the third metal foil is connected to a third end interposed between the first end and the second end of the antenna element 103. Also a metal foil 1001 made of aluminum formed in a strip of length L2, which is the fourth metal foil is connected to a fourth end which opposes the third end of the antenna element 103. That is, this embodiment has such a constitution as the third and fourth metal foils 1001 are added to the third embodiment shown in FIG. 6. According to the constitution of the antenna of this embodiment, the effect of the human body on the antenna characteristic can be reduced by using shorter metal foils than those of the antenna of the third embodiment shown in FIG. 6. As an example, results of an experiment similar to that of measuring the change in the resonance frequency due to the human body shown in Table 1 will be described below. Dimensions and other values of the antenna are a=b=50 mm, t=10 mm, Ls=36 mm, ϵ=3.6, and L1=L2=30 mm. The difference of the resonance frequencies measured in the free space and measured when the antenna is mounted on the human body is 1 MHz in this case. This is the same as the difference in the frequency when L=70 mm is employed in the antenna shown in FIG. 6. This shows that the change in the resonance frequency due to the human body can be reduced even with shorter metal foils, by employing the constitution shown in FIG. 9. In order to mount the antenna in a stable state on a human body and to increase the gain when mounted on the human body, it is preferable that the lengths of the third metal foil and the fourth metal foil are in the range of 20 mm to 50 mm.

EXAMPLE 5

Figure 10:
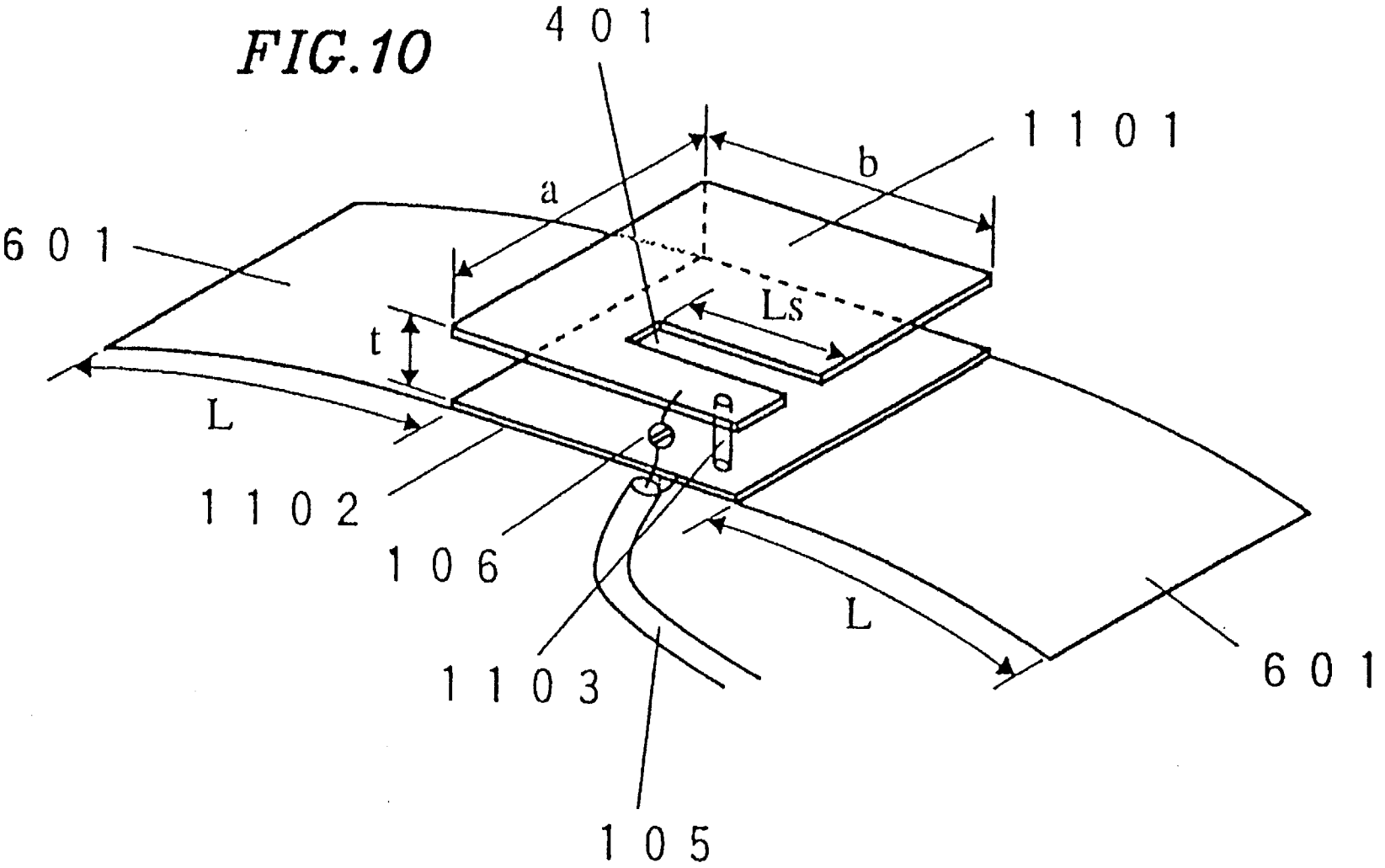
FIG. 10 is a perspective view of an antenna for mobile communication of the fifth embodiment of the invention.

FIG. 10 illustrates the constitution of the fifth embodiment of the planar antenna for mobile communication according to the invention. Among the members used in this embodiment, those having the same functions as the components in the embodiments described above are denoted by the same numerals, and description thereof will be omitted.

The antenna of this embodiment has an antenna element 1101 (first metal plate) and an antenna element 1102 (second metal plate) both made of metal plate measuring a×b. Distance between the antenna element 1101 and the antenna element 1102 is t. The antenna element 1101 and the antenna element 1102 are electrically connected to each other via a metal wire 1103 (or a metal stick) at points near the respective corners thereof. The antenna element 1101 and the antenna element 1102 are fixed at a specified distance from each other by means of the metal wire 1103. This embodiment is equivalent to a constitution obtained by replacing the dielectric substrate in the third embodiment with air. Although surface areas of the antenna elements 1101 and 1102 in this embodiment become larger, the antenna has less weight and can be manufactured at a lower cost. The dielectric substrate being interposed between the two antenna elements in the above embodiments is made of a material having a significant weight, this heavy dielectric substrate is removed in this embodiment resulting in a very light weight antenna. As a result, the antenna of this embodiment is made easier to mount on the shoulder. In this embodiment too, the metal foils 601 are connected to the antenna element 1102, and therefore change in the impedance and deterioration in the gain are extremely small even when the antenna is brought close to the human body as described in the third embodiment.

EXAMPLE 6

Figure 11:
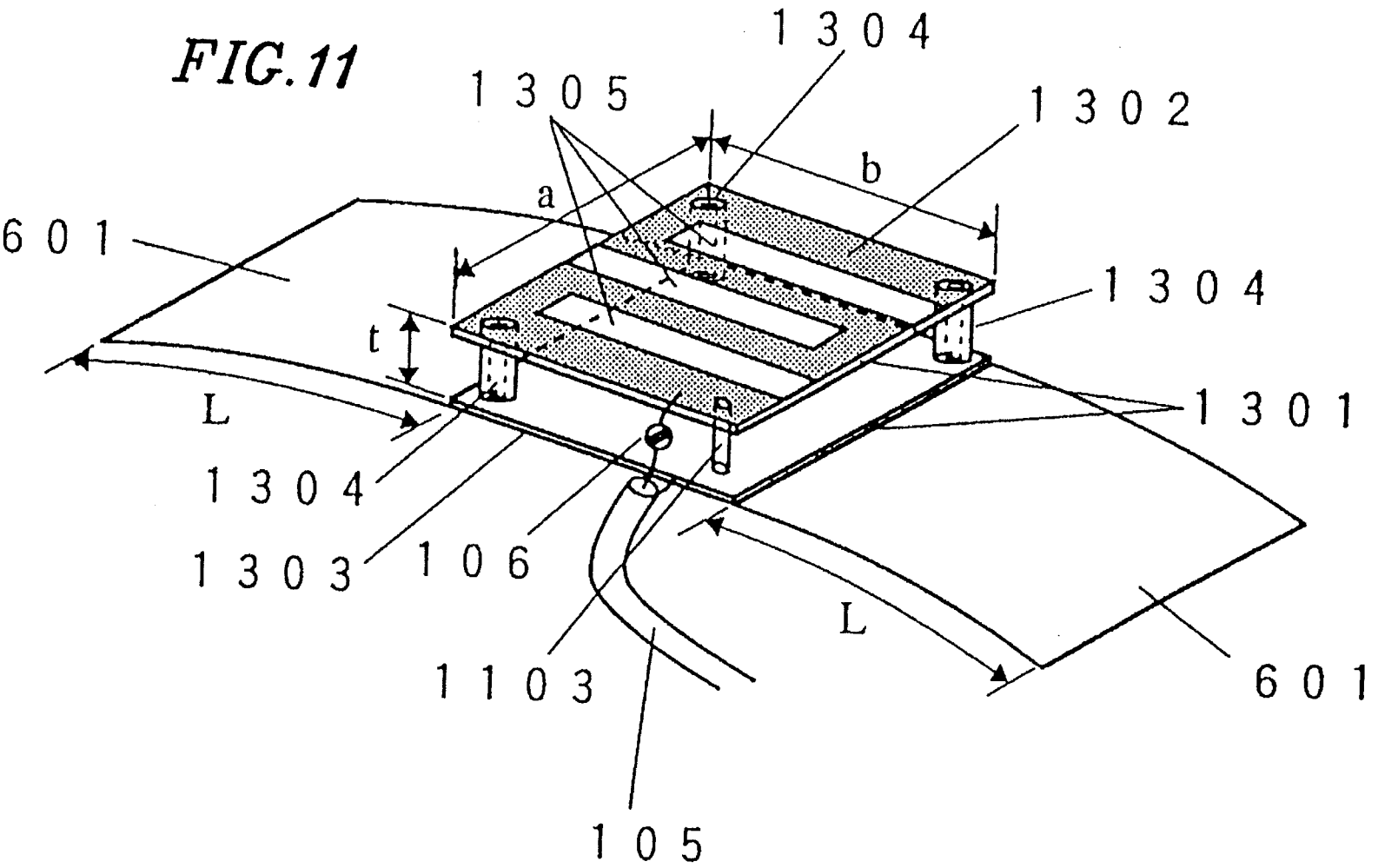
FIG. 11 is a perspective view of an antenna for mobile communication of the sixth embodiment of the invention.

FIG. 11 illustrates the constitution of the sixth embodiment of the planar antenna for mobile communication according to the invention. Among the members used in this embodiment, those having the same functions as the components in the embodiments described above are denoted by the same numerals, and description thereof will be omitted.

The antenna of this embodiment has two thin dielectric substrates 1301 which are fixed and held at a distance t from each other by spacers 1304 (fixing means). An antenna element 1302 which is a first metal plate and is formed in a pattern, is provided on an upper face of one of the dielectric substrates 1301. An antenna element 1303 which is the second metal plate, is formed on the lower face of the other dielectric substrate 1301. This embodiment has such a constitution as the antenna elements 1101 and 1102 made of metal in the fifth embodiment are formed on the two dielectric substrates 1301, respectively. The antenna element 1302 has three slits 1305. Such a configuration as a plurality of slits are formed on the antenna element so that the antenna element meanders, is called meander line configuration. Peripheral length of the antenna element can be further increased over that in the case of single slit, by providing a plurality of slits, thereby further decreasing the resonance frequency. Because the particular peripheral length of the antenna element which is determined the operating frequency can be achieved by the use of an antenna element having a smaller surface area, the antenna size can be further reduced.

In case the antenna elements 1101 and 1102 of the fifth embodiment are made of metal plates and the length Ls of the slit 401 is increased to around the length b of a side of the antenna element, the strength of the antenna element decreases and it becomes difficult to hold the antenna element. However, by forming the antenna elements 1302 and 1303 on the two dielectric substrates, respectively, as shown in FIG. 11, mechanical strength of the antenna elements can be increased and more slits can be formed. Further, it becomes easier to hold the antenna elements. Increase of the mechanical strength of the antenna elements means more stable antenna characteristics. Furthermore, since the pattern of the antenna element can be formed on the dielectric substrate by etching, the antenna elements can be made with high accuracy which results in stable resonance frequency of the antenna. In this embodiment, either the antenna element 1302 or 1303 may be made of the metal plate used in the embodiment shown in FIG. 10.

EXAMPLE 7

Figure 12:
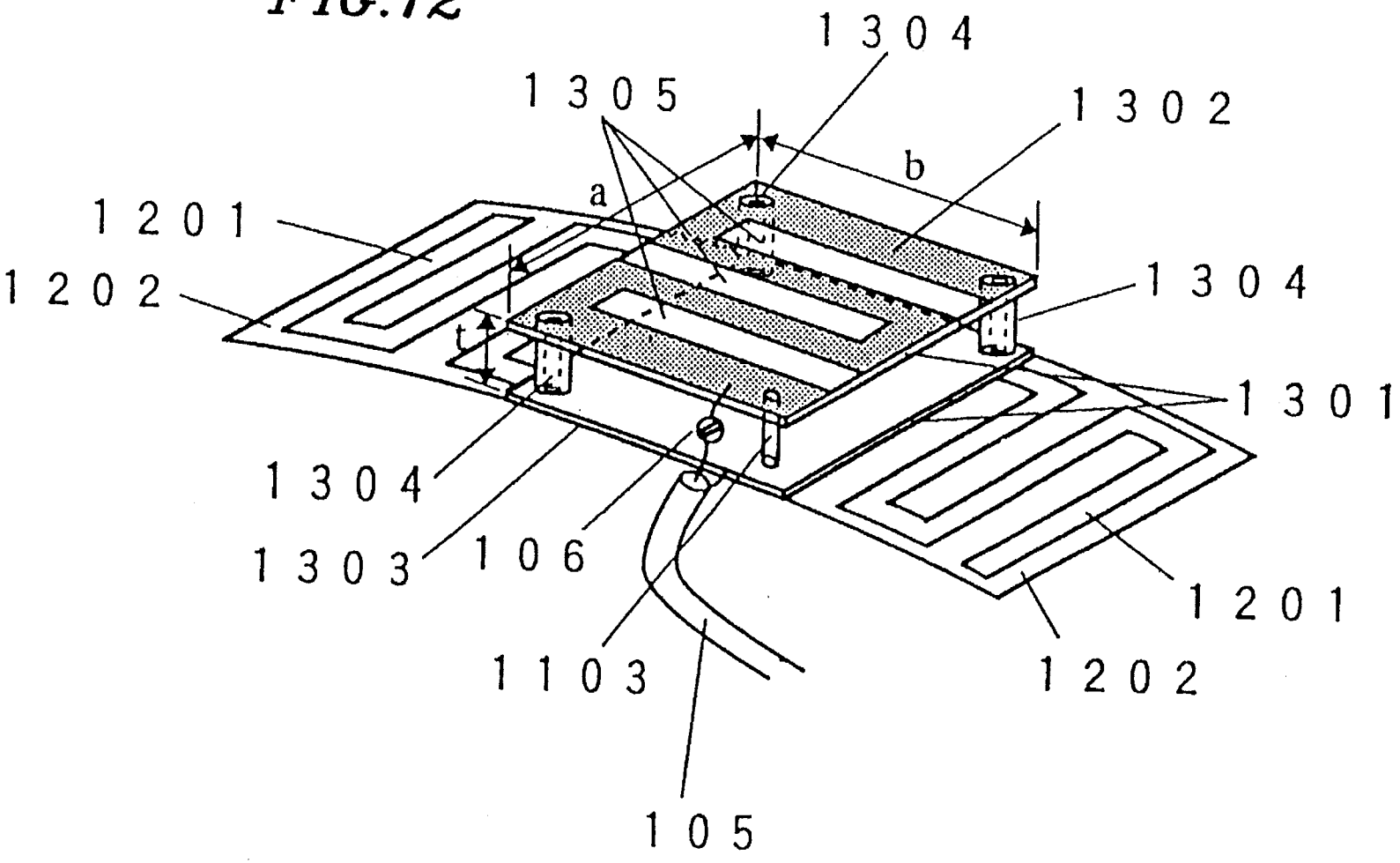
FIG. 12 is a perspective view of an antenna for mobile communication of the seventh embodiment of the invention.

FIG. 12 illustrates the constitution of the seventh embodiment of the planar antenna for mobile communication according to the invention. Among the members used in this embodiment, those having the same functions as the components in the embodiments described above are denoted by the same numerals, and description thereof will be omitted.

In this embodiment, thin metal foils 1201 of meander line configuration are connected to the first end and the second end of the antenna element 1303, respectively. The second end of the antenna element 1303 opposes the first end. These metal foils 1201 are formed on a thin resin film 1202. In this embodiment too, the metal foils 1201 functions as part of the antenna element, and a standing wave is formed also in the metal foils 1201. According to an experiment, characteristics of the antenna when it is mounted on a human body can be improved by connecting the metal foils 1201 of meander line configuration as described above. The antenna in which the antenna elements are made in dimensions a=b=60 mm and t=20 mm, the number of the slits 1305 is 24, the length of the metal foils 1201 of meander line configuration is 200 mm, and the operating frequency is 159 MHz, was used in the experiment. The measurement of the gain of the antenna mounted on the human body as shown in FIG. 7, showed an increase of the gain by 3 dB over the case where the meander line configuration is not provided to the metal foils.

The constitution in which a metal foil of the meander line is connected to the antenna element, can also be applied to those of the third through sixth embodiments.

In the fifth to seventh embodiments, though only two metal foils are connected to the antenna element, it is also possible to attach four metal foils to one side of the antenna element or the dielectric substrate. Further, two metal foils can be attached to the antenna element of the antenna having configurations corresponding to the first (FIG. 1), second (FIG. 4) and fourth (FIG. 9) embodiments. In such a case, the metal foil can be formed on a resin by a pattern forming technology including an etching process. Furthermore, when the antenna element is formed on the dielectric substrate as shown in FIGS. 1, 4, 6, 9, 11, and 12, the antenna element can be formed by the pattern forming technology including an etching process.

Although the above embodiments are described by assuming that the antenna elements are all made in the same configuration, namely squares, the antenna elements may not necessarily be squares, but may be rectangular or circular, for example.

In FIG. 7, only the antenna having two metal foils shown in FIG. 6, is used in the explanation of the application of the antenna to the human body. However, the antennas shown in FIG. 1, FIG. 4, FIG. 9, FIG. 10, FIG. 11, and FIG. 12 may also be mounted on a human body for use.

In FIG. 1, FIG. 4, FIG. 6, and FIG. 9, though the two antenna elements are connected via a though hole, it is also possible to connect them by means of a metal wire. In such a case, it is not necessary to pass the metal wire through the dielectric substrate, but the metal wire may be installed outside the dielectric substrate.

Although the dielectric substrate and the antenna elements are described as the same configurations and the same size in FIG. 1, FIG. 4, FIG. 6, FIG. 9, and FIG. 11, the antenna elements may be smaller than the dielectric substrates. In such a case, it is possible to form the antenna element using an etching process and, as a result, dimensional accuracy of the antenna element is improved thereby achieving better stability of the resonance frequency.

The two metal foils shown in FIG. 6, FIG. 10 or FIG. 11 have the same size, and the two pieces of opposed metal foils shown in FIG. 9 are made in the same size, respectively. However, each of the opposed metal foils may have different lengths, and made in asymmetrical constitution according to the dielectric substrate. Also the width of the metal foils may not have the same width as the dielectric substrate or the metal plate.

Also, the two meander lines of metal foil opposed to each other shown in FIG. 12 need not have the same length.

According to the invention, the antenna elements can be made extremely small by the use of capacitance, and it is possible to provide an antenna for mobile communication which is separated from the radio unit in order to make the main body of the radio unit sufficiently compact. Also, by the use of a variable capacitor, it is possible to obtain excellent matching of the antenna without using a ground plane.

Also by forming a slit in the antenna element or making the antenna element in a meander line configuration, and/or by attaching metal foils to the antenna element, it is possible to provide an antenna for mobile communication which is compact and light-weight enough to be easily mounted on a human body. Also it is made possible to restrain the deterioration of the basic characteristics of the antenna such as impedance and gain due to the effect of the human body to an extremely low level.

Further, because two metal foils of strip configuration are connected to both ends of an antenna element, the antenna of this invention can be mounted (put) stably on a portion (on the shoulder, for example) of a human body where the antenna characteristics are less likely affected by the human body.

Moreover, since the dielectric substrate or a part of the dielectric substrate can be removed from the portion between the two antenna elements, the antenna can be made further lighter and can be mount on the shoulder easier.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An antenna for mobile communication comprising:

a first metal plate;

a second metal plate opposed to the first metal plate, and electrically connected to the first metal plate;

a capacitor having two terminals, one of the terminals being electrically connected to the first metal plate substantially at one point; and a cable for supplying feed signals to the first metal plate and the second metal plate, the cable including a first conductor connected to the other of the terminals and a second conductor connected to the second metal plate, a first metal foil connected to a first end of the second metal plate, a second metal foil connected to a second end opposite the first end of the second metal plate, wherein the first metal foil and the second metal foil are flexible so as to follow curvature of a human body, a third metal foil connected to a third end interposed between the first end and the second end of the second metal plate, and a fourth metal foil connected to a fourth end opposite the third end of the second metal plate, wherein a length of each of the first metal plate and the second metal plate is equal to or less than 65 mm and a width of each of the first metal plate and the second metal plate is equal to or less than 65 mm.

2. An antenna for mobile communication according to claim 1, wherein each of the length of the third metal foil and the fourth metal foil is in the range of 20 mm to 50 mm.

3. An antenna for mobile communication according to claim 2, wherein a shape of at lease one of the first to fourth metal foils is a meander line configuration.

* * * * *

UNITED STATES PATENT AND TRADEMARK OFFICE

CERTIFICATE OF CORRECTION

PATENT NO. : 5,526,003

DATED : June 11, 1996

INVENTOR(S) : Ogawa et al.

It is certified that error appears in the above-indentified patent and that said Letters Patent is hereby corrected as shown below:

Column 12, line 43, delete "2" insert --1--.

Column 12, line 43, "lease" should be --least--.

Signed and Sealed this

Twenty-fourth Day of December, 1996

*Attest:*

*Attesting Officer*

BRUCE LEHMAN

*Commissioner of Patents and Trademarks*